US012181181B2

(12) United States Patent
Mantyla

(10) Patent No.: US 12,181,181 B2
(45) Date of Patent: Dec. 31, 2024

(54) HYBRID ROOF VENT

(71) Applicant: Canplas Industries Ltd., Barrie (CA)

(72) Inventor: James Brian Mantyla, Barrie (CA)

(73) Assignee: CANPLAS INDUSTRIES LTD., Barrie (CA)

( * ) Notice: Subject to any disclaimer, the term of this patent is extended or adjusted under 35 U.S.C. 154(b) by 236 days.

(21) Appl. No.: 17/480,235

(22) Filed: Sep. 21, 2021

(65) Prior Publication Data

US 2022/0099317 A1 Mar. 31, 2022

(30) Foreign Application Priority Data

Sep. 30, 2020 (CA) ..... CA 3094866

(51) Int. Cl.
*F24F 7/02* (2006.01)

(52) U.S. Cl.
CPC ..... *F24F 7/025* (2013.01)

(58) Field of Classification Search
CPC ..... F24F 7/025
USPC ..... 454/341, 347, 348, 356, 366, 368
See application file for complete search history.

(56) References Cited

U.S. PATENT DOCUMENTS

| | | | | |
|---|---|---|---|---|
| 2,805,615 | A * | 9/1957 | Rudy | F24F 7/025 415/214.1 |
| 4,123,968 | A | 11/1978 | Malott | |
| 4,432,273 | A | 2/1984 | Devitt | |
| 4,608,834 | A * | 9/1986 | Rummel | B60H 1/00378 296/216.02 |
| 6,155,008 | A | 12/2000 | McKee | |
| 6,520,852 | B2 | 2/2003 | McKee et al. | |
| 6,612,924 | B1 | 9/2003 | Mantyla et al. | |
| 6,767,281 | B2 | 7/2004 | McKee | |
| 7,507,151 | B1 | 3/2009 | Parker et al. | |
| 7,774,999 | B2 | 8/2010 | McKee | |
| 8,915,778 | B2 | 12/2014 | Boehling et al. | |
| 9,243,813 | B2 | 1/2016 | Mantyla et al. | |
| 9,494,330 | B2 | 11/2016 | Bushey | |
| 9,557,074 | B2 | 1/2017 | Mantyla et al. | |
| 2005/0191957 | A1 | 9/2005 | Demetry et al. | |
| 2010/0304660 | A1 | 12/2010 | Boehling et al. | |

(Continued)

FOREIGN PATENT DOCUMENTS

| | | |
|---|---|---|
| CA | 2 267 823 C | 12/2001 |
| CA | 2 309 941 C | 7/2009 |

(Continued)

OTHER PUBLICATIONS

Translation, DE-102014222965-A1 (Year: 2015).*

*Primary Examiner* — Jessica Yuen
(74) *Attorney, Agent, or Firm* — Hoffmann & Baron, LLP

(57) ABSTRACT

A dual function roof vent having a main body having an air passageway extending therethrough and being sized and shaped to fit onto an opening in a roof where the air passageway defines an air to flow path between the interior and the exterior of a building. The air passageway also defines a vent net free flow area. A collar is attached to and extends below the main body, and the collar is sized and shaped to fit through the roof opening. The collar including air inflow gaps, and a fan mount, with an electrically powered fan mounted to said fan mount. The collar air inflow area, including the air inflow gaps, is within about 5% of the vent net free flow area defined by the air passageway.

24 Claims, 7 Drawing Sheets

(56) References Cited

U.S. PATENT DOCUMENTS

| | | | | |
|---|---|---|---|---|
| 2010/0330898 | A1 | 12/2010 | Daniels | |
| 2012/0178357 | A1 | 7/2012 | Rheaume | |
| 2015/0253021 | A1* | 9/2015 | Daniels | F24F 13/32<br>29/897.3 |

FOREIGN PATENT DOCUMENTS

| | | | | |
|---|---|---|---|---|
| CA | 2 364 672 | C | 6/2010 | |
| CA | 2 371 455 | C | 10/2010 | |
| CA | 2 536 023 | C | 2/2013 | |
| CA | 2 803 775 | C | 9/2014 | |
| CA | 2 597 366 | C | 3/2015 | |
| CA | 2 766 888 | C | 5/2018 | |
| DE | 102014222965 | A1 * | 5/2015 | A01K 1/0058 |

* cited by examiner

HYBRID ROOF VENT

CROSS-REFERENCE TO RELATED APPLICATIONS

This claims the benefit of Canadian Application No. 3,094,866, filed Sep. 30, 2020, the contents of which is incorporated by reference herein.

FIELD OF THE INVENTION

This invention is directed generally to the field of ventilation products and more particularly to roof vents of the type that provide for the ventilation of enclosed building spaces such as attics such as may be found in low rise residential or commercial buildings. Most particularly this invention is directed to a type of roof vent which can be used to permit air to vent from attic spaces for temperature and moisture control as may required by building codes or the like.

BACKGROUND OF THE INVENTION

Roof vents have been known and have been used extensively in residential and other types of building construction to provide for air flow exchange from inside unheated spaces such as attics, for example. Ventilation is required under most building codes to prevent the build up of moisture in such an unheated attic space, as well as in some cases to help with temperature control in the occupied portion of the building below the attic. For example, exchanging hot air that has built up during the day with cooler night air can reduce the cooling load on a building cooling system used to cool the building below the attic. In an active roof vent a fan is used to cause the air to be vented. In a passive vent system, the ventilating air typically enters the attic space at the eaves, through eave vents, and then may drift upwardly and out of the attic space through a roof vent located towards a top of the roof. This sets up a gentle air circulation system.

Many forms of roof ventilation devices have been made and used in the past, including stand alone passive roof vents, ridge vents, vents with power fans, passive vents with rotating tops that may help to draw out the air and even devices that include electrically powered fans which may have a source of power from solar energy and/or grid energy.

The capacity of a passive ventilation device to provide ventilation is determined by the amount of the net free flow area formed through the body of the ventilation device. The net free flow area is defined as the total cross-sectional area of the narrowest passage through the vent which defines the smallest free-flowing cross-section area through which the air can flow. The smallest area is the limiting factor for the volume of passive air flow and this is why this measure is used. Typically, a vent structure is positioned over a hole in the roof, and the air flow area through the vent is about the same as the flow area of the hole in the roof. In this way the vent design is optimized for maximum net free flow area for a certain sized roof opening.

A well-designed roof vent lets the air out, but it also prevents pests, vermin and the like from entering the vented space through the net free flow area. This is done through the use of various designs of grills, screens, baffles and the like. The air can get out, but the pests cannot get in. Well designed vents also limit the ability of inclement weather, such as rain and/or snow, from entering the attic through the vent body, again through the use of screens, baffles or the like. Typically air flow passageways are designed to restrict weather from penetrating from the outside through the roof vent to the inside. The solid areas of the grills which block the pests and weather, to the extent that they also block the air flow, must be deducted from the total air flow opening area when calculating the true size of the net free flow area for any given ventilation device. The number of vents required for any installation is a function of the volume of the space being ventilated and the amount of the net free flow area of the device. The larger the net free flow area, the fewer devices are required to vent the same inside air volume being ventilated.

Active vents, which include a fan, may not have the same design restriction of having a predetermined net free flow area, as the forced flow of air from the fan can increase the air flow rate to a rate well above the passive air flow rate through a passive venting device. For vent designs with fans, efficient aerodynamic design requires closely housing the fan impeller within a tubular housing which acts as an air foil to allow the fan to develop some positive air pressure to push the air out of the attic or other closed space through the vent body. Alternatively negative air pressure may be created by an externally mounted fan to draw the air up out of the space to be vented, again through the vent body and the use of an air foil arrangement which extends down into the inside volume to be vented. Prior art designs have used fans mounted at locations that are above, at or below the level of the roof. In an active vent the fan housing is typically the only air flow path through the vent. Further the fan is typically mounted with the impeller directly across the flow path, closely within the housing. The blades of the fan impeller then occupy a significant percentage of the cross-sectional area of the tubular housing or air foil which defines the air flow passageway. This design permits the fan to develop proper air flow force when the fan is turned on.

Having the air flow passageway substantially blocked by the impeller blades would be an issue for a passive vent but it is not an issue for an active vent because when the fan is turned on, the air is pushed out at a rate defined by the fan capacity. The fan capacity is a function of the size and shape of the impeller, the size and shape of the fan housing, the size of the electric motor and the amount of the electrical power being provided. When the fan is not energized however, the hot air and moisture can build up in the space to be ventilated as there is not enough passive air flow otherwise past the impeller through the vent body.

Although the fan can be energized on demand with grid power, more recently designs for solar powered fans have been proposed. While energy efficient, as not requiring any grid power, such designs can suffer from not having an on-demand power source. For example, although they can force air out during the day with an adequate amount of light to create enough photovoltaic electricity, in the event there is not enough light then there may be no power. For example, at night there is not enough light to create photovoltaic energy and there may not be enough light if the solar panel is covered with snow. However, the need to continually and adequately ventilate the attic space still exists both at night and in snowy weather. Consequently, some of the prior art suggests adding a grid power source to the solar power source. However, this is more expensive and awkward requiring a building wiring connection to the roof vent itself. In this case the fan could be considered an electrical appliance which could require a separate electrical circuit, which is also expensive. Further, even with a backup of grid power the fan still needs to be energized to achieve the desired venting. In the event the building operator forgets to turn on the fan, when solar power is not available, then there is essentially no ventilation happening. What is desired is a simpler and more foolproof venting system.

Some examples of prior active ventilation devices, including both solar powered and grid powered devices for venting attics or the like include:

U.S. Pat. No. 9,494,330
U.S. Pat. No. 8,915,778
U.S. Pat. No. 7,507,151
U.S. Pat. No. 4,432,273
U.S. Pat. No. 4,123,968
United States Patent Publication No. US 2012/0178357 A1
United States Patent Publication No. US 2010/0330898 A1
United States Patent Publication No. US 2010/0304660 A1
United States Patent Publication No. US 2005/0191957 A1

Some examples of prior devices which are passive include:

Canadian Patent No. 2,267,823
Canadian Patent No. 2,309,941
Canadian Patent No. 2,364,672
Canadian Patent No. 2,371,455
Canadian Patent No. 2,536,023
Canadian Patent No. 2,597,366
Canadian Patent No. 2,766,888
Canadian Patent No. 2,803,775
U.S. Pat. No. 6,155,008
U.S. Pat. No. 6,520,852
U.S. Pat. No. 6,612,924
U.S. Pat. No. 6,767,281
U.S. Pat. No. 7,774,999
U.S. Pat. No. 9,243,813
U.S. Pat. No. 9,557,074

SUMMARY OF THE INVENTION

What is desired is a ventilation device design which includes a fan for active venting or forced air turnover in the ventilated space and a source of power for the fan. A preferred source of power is a solar power source such has an associated solar panel. What is also desired is a ventilation device design which can allow for passive airflow when the fan is not energized, and which includes the same net free flow area of a passive vent of the same or equivalent size. In particular what is desired is an energy efficient ventilation device which has a fan powered by an intermittent power source, such as a solar panel or an electrical storage device associated with a solar panel and which can provide a predetermined and rated passive ventilation capacity when the fan is not energized, such as at night.

What is desired is a vent design where notwithstanding the presence of an impeller in a fan housing substantially blocking the net free flow area through the fan housing, there is enough net free flow area that the vent functions as a passive vent with a predetermined net free flow area when the fan is turned off or not energized. What is also desired is a vent design which provides a fan housing and a functional aerodynamic design to permit the fan to blow air out of the space to be vented to the outside when the fan is energized.

What is also desired is a ventilation device that provides for passive air flow through a predetermined net free flow area in case the fan is not energized regardless of the reason for the fan not being energized. So, even if there is power such as grid power available, in the event the building operator simply omits to turn the fan on to force out the air from the enclosed space there is a desire for a rated passive ventilation flow capacity. What is desired therefore is a ventilation device that includes the features of both powered or active ventilation devices and passive ventilation devices.

In this disclosure the term hybrid roof vent refers to a roof vent which includes the positive functional ventilation characteristics of both a passive vent and an active vent device.

Therefore, according to one aspect of the present invention there is provided a hybrid roof vent comprising:

a main body having an air passageway and being sized and shaped to fit onto an opening in a roof, said opening defining an air to flow path between the interior and the exterior of a building said air passageway defining a vent net free flow area, a collar attached to and extending below the main body, said collar being sized and shaped to fit through said roof opening, said collar including air inflow gaps, said collar further including in a fan mount, and an electrically powered fan mounted to said fan mount, wherein a collar air inflow area, including the air inflow gaps, is within about 5% of the vent net free flow area.

BRIEF DESCRIPTION OF THE DRAWINGS

Reference will now be made by way of example only to preferred embodiments of the invention by reference to the following drawing in which.

DETAILED DESCRIPTION OF THE PREFERRED EMBODIMENTS

Figure 1:
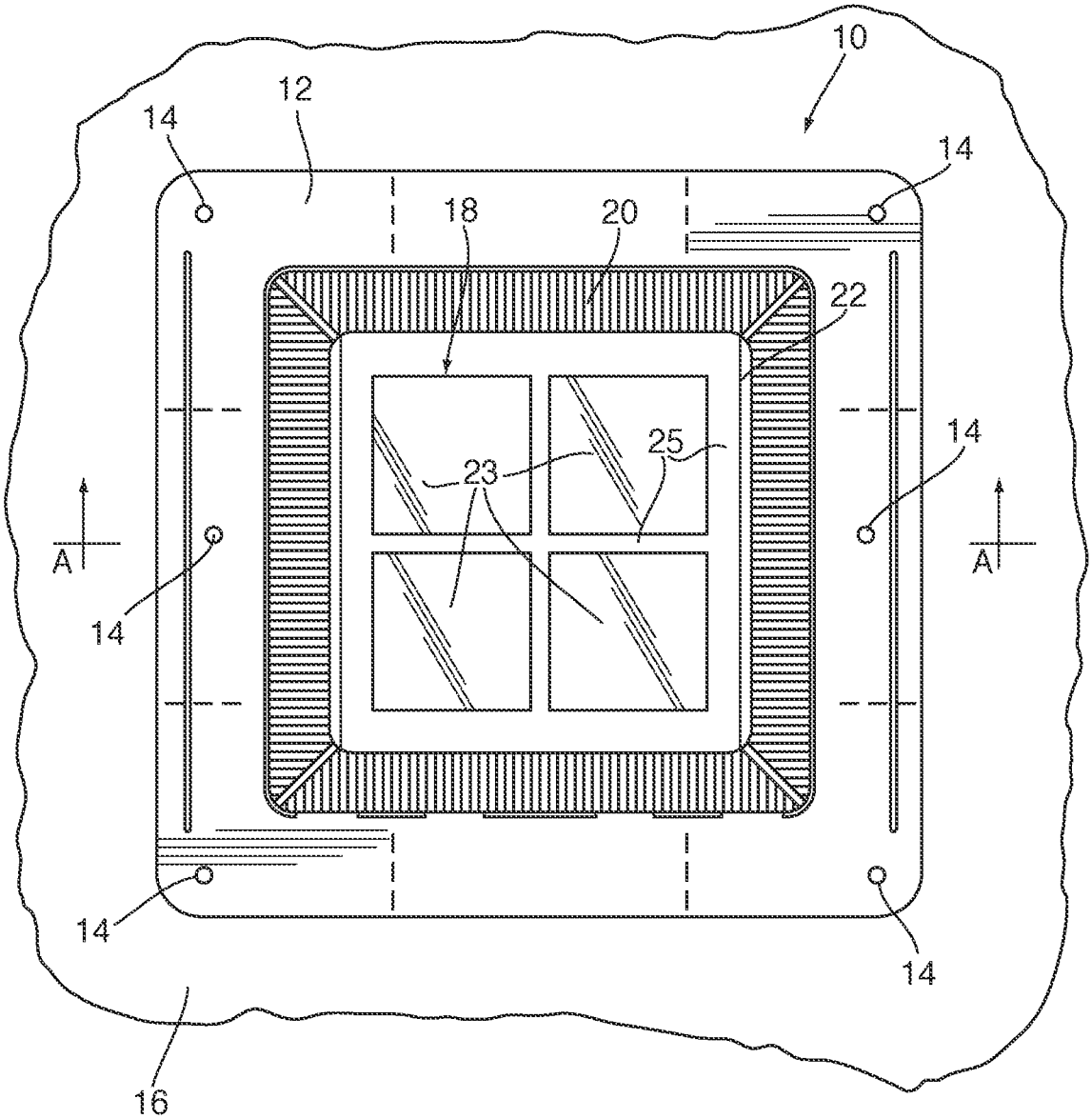
FIG. 1 is a top view of one preferred embodiment of the present invention.

A roof vent 10 according to the present invention is shown in FIG. 1. The roof vent 10 includes an attachment flange 12, with guide holes 14 for fasteners, such as roofing nails (not shown). The fasteners are used to attach the flange, and thus the vent 10 to an underlying roof 16. A central portion of the vent is raised and is shown at 18. An air flow grill 20 is shown which extends around the upper edge of the raised portion 18 in this embodiment.

A solar panel 22 may be positioned on a top side of the central portion 18. The solar panel can be of any readily available type, and the one shown has four photovoltaic sections 23, set within a frame 25. The solar panel can be of any suitable make and should be sized to fit onto the top of the central portion of the vent. In other words, different sized vents may have different sized solar panels.

Figure 2:
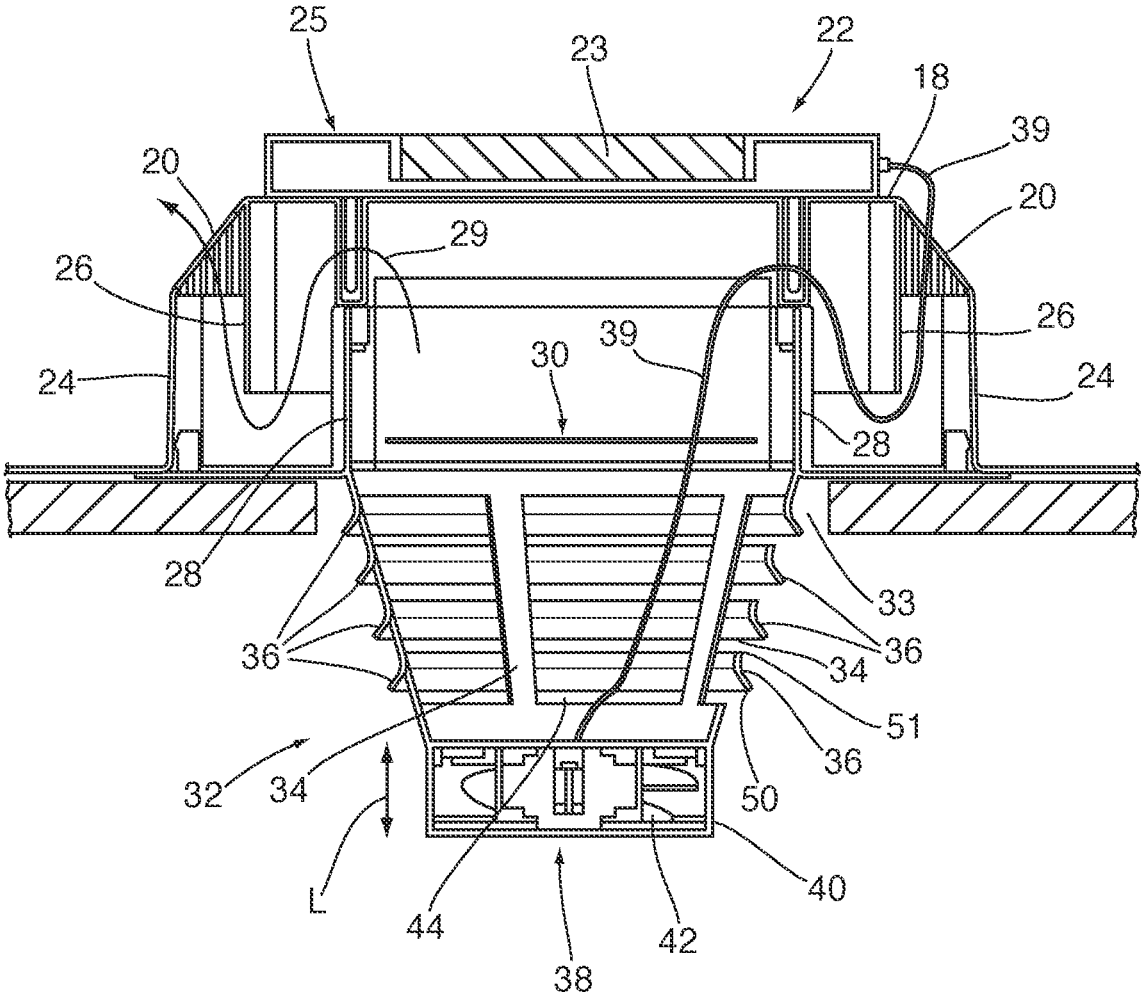
FIG. 2 is cross-sectional view along lines A-A of the embodiment of the invention of FIG. 1 showing the device extending through an opening in a roof.

FIG. 2 shows a cross-sectional view of FIG. 1. The solar panel 22 is shown on the top of the central portion 18. The air flow grill 20 is shown along the outer upper edge of the raised portion 18. A continuous side wall 24 is located below the air flow grill 20 above the attachment flange 12. Inside of the raised central portion 18 is located a pair of air flow baffles, 26 and 28 which define a sinuous air flow passageway indicated by arrow 29 through the raised portion 18. This design of an air flow passageway greatly inhibits the intrusion of inclement weather back through the vent in a direction opposite to arrow 29, as described in Canplas U.S. Pat. No. 2,766,888.

The inner baffle 28 defines a continuous wall around a central opening 30. According to a preferred embodiment of the present invention, below the central opening 30 is positioned a collar 32 which extends down through the roof opening 33 when the vent is placed in position on a roof. The collar 32 includes support columns 34, louvers 36 and a fan 38 in housing 40, all as described in more detail below. A power supply wire 39 connects the fan 38 to the solar panel 22.

Most preferably the collar 32 and fan housing 40 are integrally formed from molded plastic material such as the plastic used to form the above roof portion of the vent. The present invention also comprehends forming the collar 32 as a separate element which can be added as needed in the field. Reasonable results have been achieved with polypropylene but other injection moldable plastic compositions may also be used. This plastic needs to be strong enough to reliably retain the weight of the fan 38, but with a reasonably light-weight electric fan 38, this can be readily accomplished. However, enough support columns 34 are required of enough thickness to achieve the required load bearing of the fan mount as will be understood by those skilled in the art. By being molded from plastic the collar 32 can be easily and quickly mass produced for a reasonable cost.

The fan housing 40 needs to define a sufficient length of air foil to allow the fan 38 to generate positive pressure across the fan 38 impeller 42 to drive the air upwards, when the fan is powered. However, a reasonably short length of air foil is all that is required according to the present invention as shown at L, for the reasons described below. In the present invention the housing or air foil stops well short of the roof opening, which is contrary to the typical fan installations of the prior art. The fan housing 40 is most preferably circular, to better closely enclose the impeller 42 and the fan housing 40 and thus impeller 42 are most preferably centrally located below the opening 30 in the vent body by being centered in the circular collar 32.

In addition to supporting the weight and position of the fan 38 and fan housing 40, the support columns 34 of the collar 32 also support a plurality of louvers 36. The collar 32 is preferably tapered or angled so that it is of a smaller cross-sectional area and diameter at a lower end, in this embodiment, than at a top end where the column extends through the roof opening 33. The louvers 36 are preferentially sized, shaped and located on the collar 32 to provide a dual function. On the one hand, the louvers 36 are generally transverse to the expanding air flow generated by the fan as the air current is driven up the column towards the roof by the fan 38. Although there are air gaps 44 between the louvers according to the present invention, the gaps 44 are staggered outwardly to encourage any fan 38 generated air current to travel up inside the collar 32 and through the vent opening 30. Preferably the louvers 36 permit air to be drawn into the collar 32 to join the moving air column formed by the fan above the short air foil L formed by the fan housing 40. The consequence of the tapered louvered column 32 including inwardly directed louvers is that a smaller fan can be used to move more air. It will be understood by those skilled in the art that an optional tubular extension 45 of the fan housing (shown in dotted outline) can be provided extending upwardly if desired, without affecting the passive air flow of the device when the fan is not activated as described below.

However, the advantage of the tapered column with louvers 36 as described can now be better understood. When the fan is not energized, the impeller 42 blocks a substantial portion of the air flow that might otherwise pass through the air foil formed by the fan housing 40, thereby blocking passive ventilation through the fan housing 40. It will be noted that according to a preferred embodiment of the present invention each of the louvers 36 is angled with a lower outer edge 50 located further away from a center line of the collar 32 than an upper inner edge 52. As well, the successively higher louvers 36 extend successively further outwardly so that as the collar 32 gets closer to the roof the louvers 36 extend further and further away from a center line of the collar 32. In this way the louvers 36 are stacked above and outside of one another successively, in the upward or air ventilation direction.

The passive air flow can now be understood. As the hot air rises, it will be captured under the louvers 36 and directed inwardly into the collar 32 by each successive louver 36. In a rising passive air flow the upwardly outwardly tapered design allows more of the rising air flow to be captured as each successively higher louver 36 projects further out into the rising air currents. Each louver 36 is spaced from the next adjacent louver 36 by an air gap 44. The air gap 44 allows successive louvers 36 to direct the flow of passive rising air inwardly, and thus up through the central opening 30 in the roof above. The total area of the air gaps 44 for the collar 32 is preferably about as large as the net free area capacity of the roof vent, as defined by the grill 20 in the above raised central roof portion 18 of the vent 10 or the hole in the roof. A larger total air flow area in the gaps than the net free flow area in the grill doesn't add to the capacity of the vent, as the limitation is set by the grill openings on the exit from the top of the vent structure or the hole in the roof. A smaller air flow area through the gaps as compared with the net free flow area as defined by the top grill structure will define a new lower limit for the net free flow area for the passive mode for roof vent device of the present invention and therefore limit the usefulness of the design by requiring more vents per vented volume of air space to achieve the same passive air turnover. As can now be understood the preferred area of the gaps in total is about the same as the net free flow area of the grill section. Preferably the net free flow area is within 5% of the net free flow area of the rest of the vent, more preferably within about 1% and most preferable about the same as the net free flow area of the rest of the vent. This equal sizing of the net free flow areas may also help balance the aerodynamic loads during active venting.

As shown the tapered collar 32 is circular in cross-section. However, the present invention comprehends that other cross-sectional shapes could be used such as rectangular, triangular or multifaceted, but reasonable results have been attained with the circular cross-sectional area as shown. What is preferred, but not essential, regardless of the shape of the cross-sectional area, is to include the taper as part of the collar shape, with the taper going from narrower to wider as the collar 32 gets closer to the underside of the roof as shown. It will also be noted that the individual louvers 36 are preferably, but not necessarily curved, in cross-section, to gently deflect the rising air flow into the central portion or inside of the collar, i.e. below the roof opening 30. While this curved configuration is preferred it will be understood that the present invention comprehends various forms of louvers and air gaps could be used including straight angled louvers. What is preferred is to have a lower edge 50 which projects outwardly and an upper edge 52 which ends closer to the inside of the collar than the lower edge and most preferable below the outer edge of the next adjacent louver above.

Figure 7:
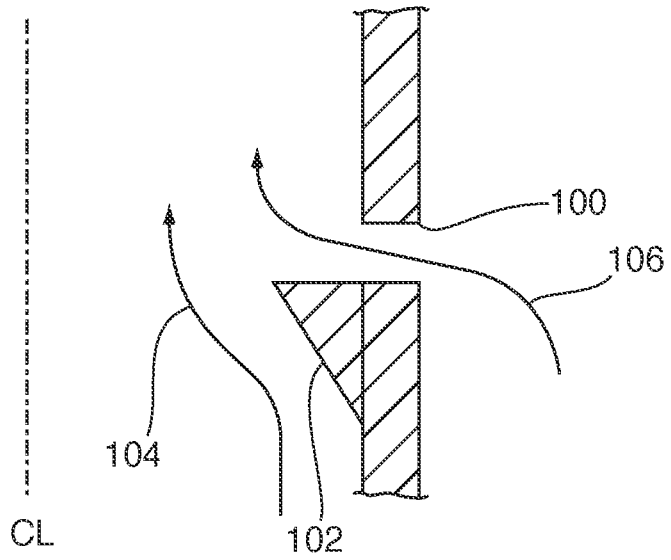
FIG. 7 is a partial cross-sectional view of an alternate embodiment to the invention of FIG. 1.
Figure 8:
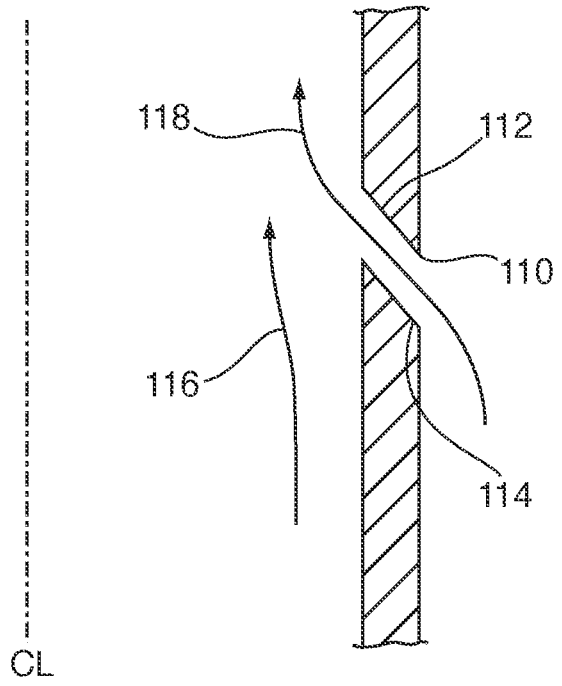
FIG. 8 is a partial cross-sectional view of a further alternate embodiment.

Although a tapered column is the most preferred design, other shapes of collars are also comprehended. For example, a cylindrical column with angled air flow slots may also work, as shown at 51 as well as straight slots which are provided with inner airfoils 53 as shown in FIGS. 7 and 8.

Figure 3:
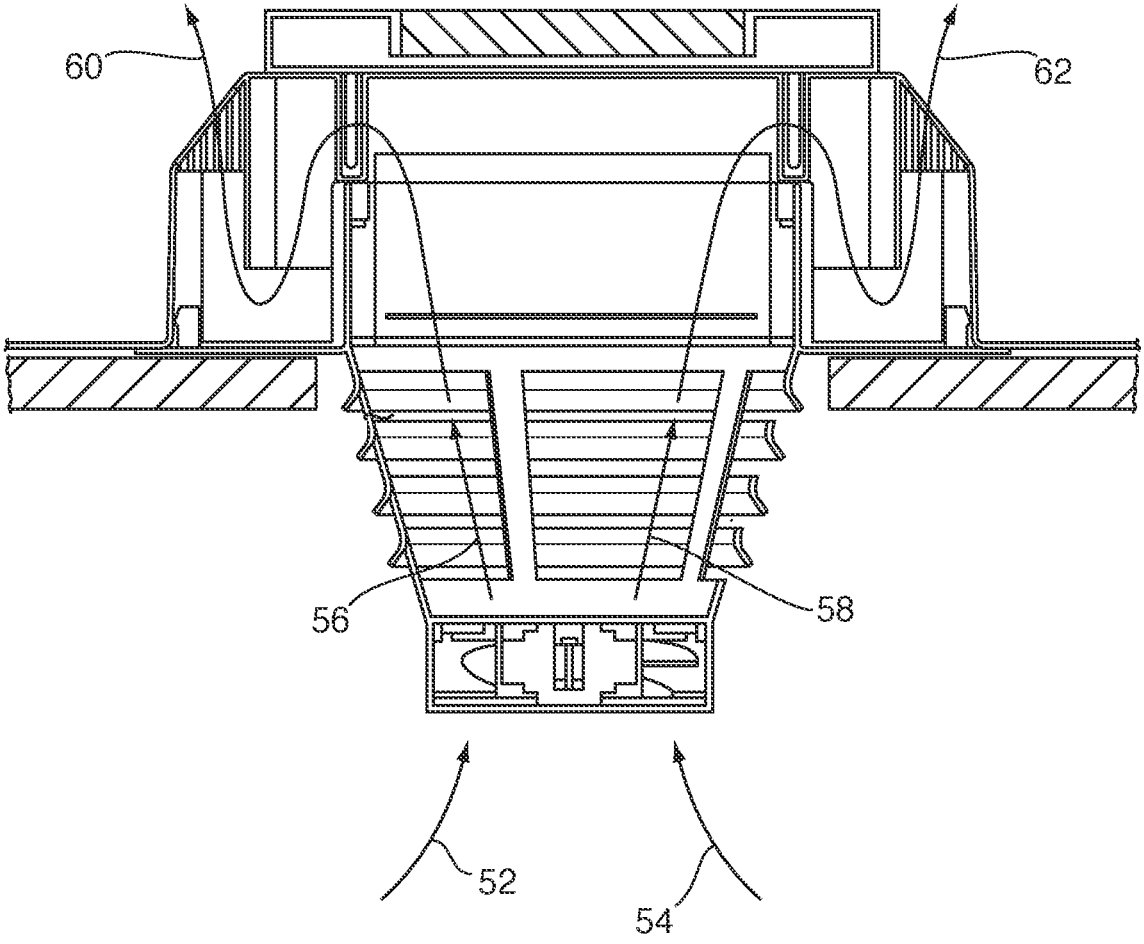
FIG. 3 is a cross-sectional view of the embodiment of FIGS. 1 and 2 showing active air flow through the vent by means of an electric fan.

FIG. 3 shows the air flow when the fan 38 is in active mode, namely when the fan 38 is energized. The air flow is drawn into the fan as shown by arrows 52, 54 and then accelerated by the fan impeller up through the collar 32. By means of the upward taper of the collar 32, as the fan driven moving air column expands laterally as shown by arrows 56 58, it is still largely captured within the inner part of the collar, and until it reaches the roof opening 30. Then the air flows over and under the baffles 28 and 26, and finally out through the grill 20 as shown generally by arrows 60, 62.

It will be appreciated that some aerodynamic resistance may be created by the convoluted air passageway through the upper portion of the roof vent 10 which can potentially create a modest amount of back pressure, but the primary air flow restriction is the grill 20 which defines the net free flow area of the vent. It can now be understood that by sizing the combined gaps 44 between the louvers 36 to be equal to the net free flow area of the grill 20, an approximate balance of aerodynamic forces may be achieved (less the frictional effects noted above). According to the present invention there is the possibility of some additional air flow inwardly through the air gaps 44 between the louvers which may add to the amount of fan driven air flow which can be expelled through the grill 20 on the roof top.

Figure 4:
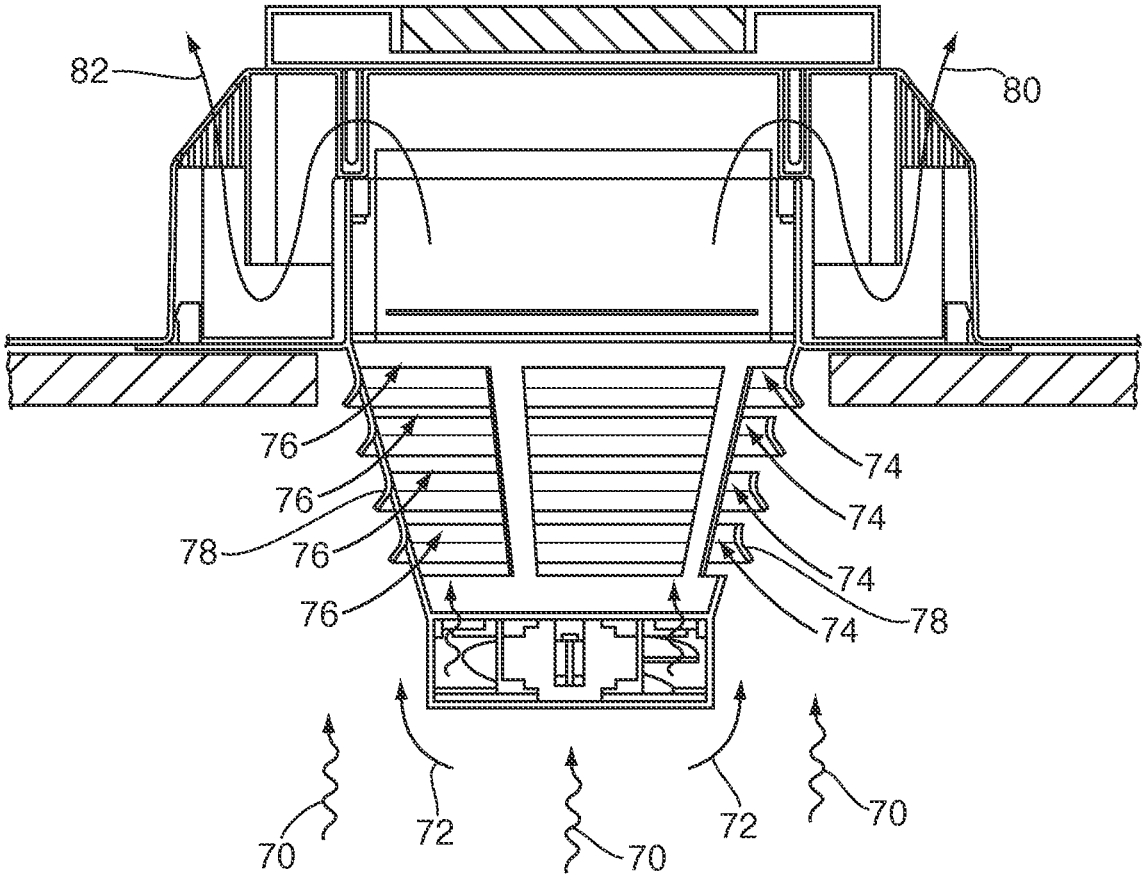
FIG. 4 is a cross-sectional view of the embodiments of FIGS. 1 to 3 showing passive air flow through the louvers.

FIG. 4 shows the embodiment of FIG. 3 in passive ventilation mode. In this case, the air will be gently rising from below as shown by arrows 70. Because the fan impeller blocks most of the air flow opening through the fan housing, the air will largely be diverted at 72 around the fan and impeller. Instead as it rises it will be captured by the outwardly extending louvers 36 and then be directed by the shape of the louvers inwardly through gaps 44 as shown by arrows 74, 76. Although a number of shapes and angles of louvers can be used, in this embodiment, curved louvers are used. The curves are presented as convex surfaces facing generally inwardly and concave surfaces facing outwardly at 78. The convex inwardly facing curve forms of small air foil which may cause an acceleration of the air flow inwardly under laminar flow conditions according Bernoulli's law. Thus, the convex curves may be considered analogous to a wing which creates a lower pressure over the curved surface, which encourages more air speed up through the gaps 44 between the louvers 36. As this is a passive air flow, this effect is likely to be small, but it is still helpful, as will be understood by those skilled in the art. Once in the collar, the air flows passively up through the gap 30 and then through the sinuous flow path and out of the grill 20 as shown by arrows 80, 82.

As noted above, the total air flow area of the gaps 44 between the louvers 36 is most preferably about the same as the total net free flow area for the grill 20 on the roof top or outer portion 22 of the vent device. As a result, the total passive air flow rating for the vent is the same as for a standard passive vent of the same size. According to the present invention therefore it can function in an active mode as described above, and when not in active mode it is always providing a predetermined and rated amount of passive ventilation. No extra wiring, switches or attention is required to achieve the required rated passive venting, due to the design for the passive venting air flow. The present invention is therefore a hybrid vent, combing both features of active vents and passive vents in one vent assembly.

Figure 5:
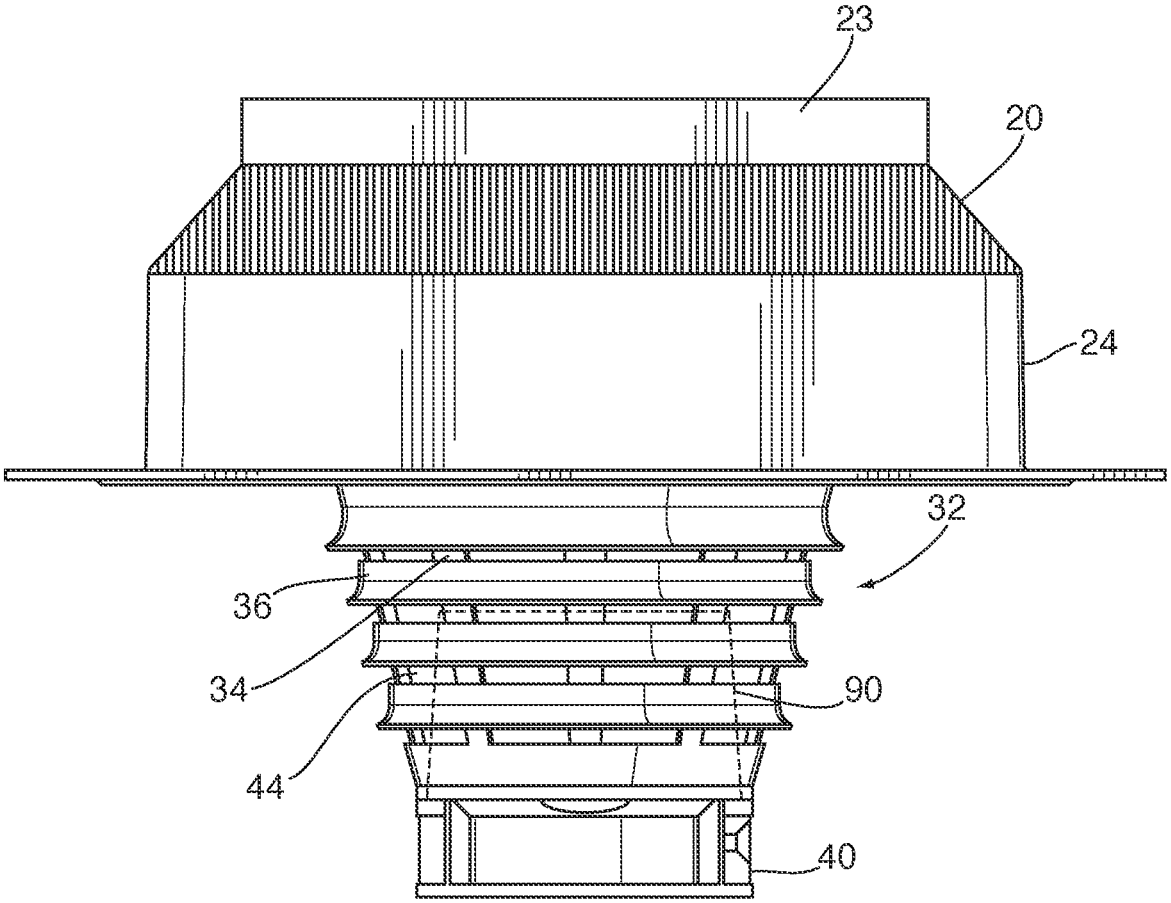
FIG. 5 is a side view of an alternate embodiment of the invention of FIG. 1.

FIG. 5 is a side view of a further embodiment of the present invention. In this embodiment, in addition to the air foil provided by the fan housing, a further air foil extension 90 (shown in dotted outline) is provided within the collar 32 itself to further direct the air flow up and out of the vent. This is an optional feature which may be desirable in some circumstances depending upon how powerful a fan is being used. Preferably the air foil extension 90 is circular and matches the air foil created by the housing 40. Further by being located inwardly of the inner most louver, the extension 90 will not interfere with the passive air flow as described above for the previous embodiment.

Figure 6:
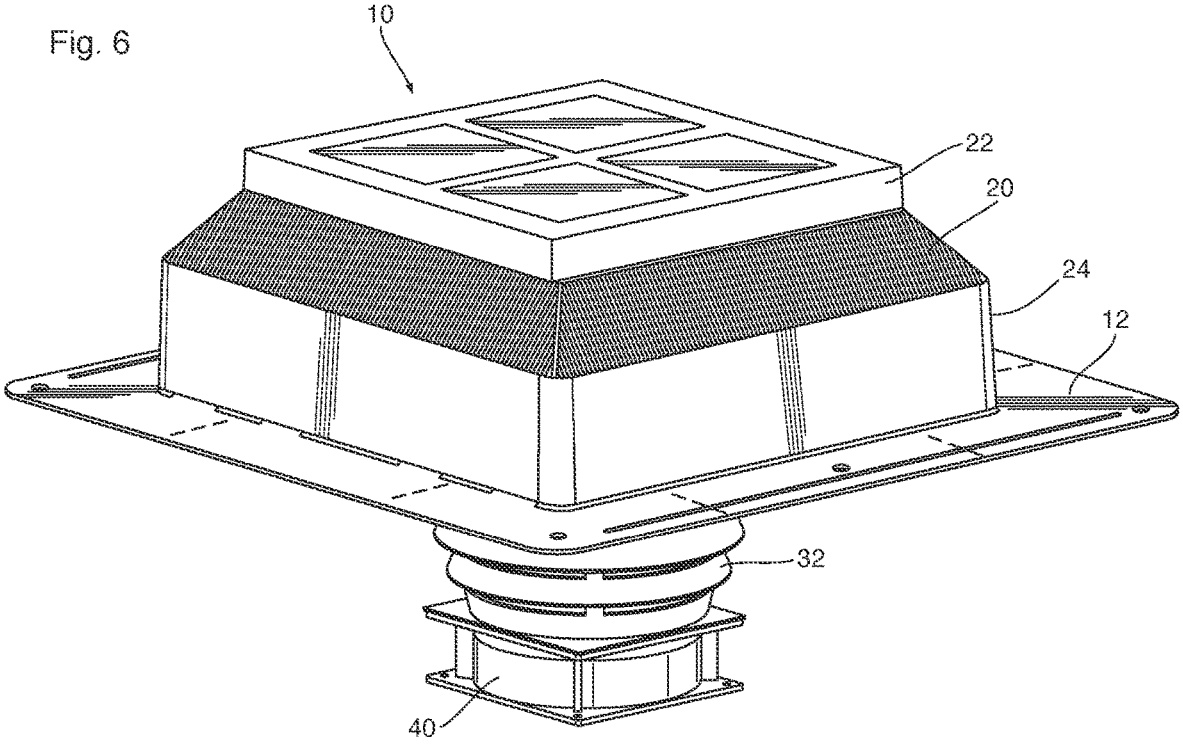
FIG. 6 is a perspective view of the present invention.

FIG. 6 is a perspective view of the present invention in which like numbers are used for like features as in FIG. 1. It can now be understood that the present invention can be formed in discreet components from molded plastic and then assembled to form the finished product. In particular, the collar can be separately molded and then welded, heat staked, glued or otherwise fastened with fasteners to the underside of the main body of the vent.

FIG. 7 is a partial cross-sectional view of an alternative embodiment for the air inflow gaps on the collar. In this case the collar 32 is a cylinder, having a centerline CL, rather than a tapered cone as in the previous embodiment. Further, rather than having louvers which project outwardly as in the embodiment discussed above, in this embodiment the air inflow openings into the collar 32 take the form of generally rectangular slots 100 in side view. To improve the air flow into and through the collar, air deflection surfaces 102 are molded in below each of the slots 100. Again, in laminar flow circumstances, such as might arise in passive air flow, these surfaces 102 will create a low-pressure region to encourage air flow into the collar through the slots 100. The surfaces 102 can be straight as shown or curved. The airflow is indicated with arrow 104 inside of the collar 32 and with arrow 106 which is airflow passing from the outside to the inside of the collar 32.

FIG. 8 is a further embodiment of the present invention depicting an air inflow slot 110 again in a cylindrical collar 32 having a center line CL. In this embodiment the slot 110 is provided with angled slot surfaces 112 and 114 again to encourage passive air flow to the inside of the collar. As shown, both the bottom and top face of the slot 110 slope up and in from the outside to the inside. Inside air flow is depicted by arrow 116 and air passing from the outside to the inside through the slot 110 is shown by arrow 118. It will be further understood that while these two alternate embodiments are shown on cylindrical collars they could also be used on tapered collars such as show in FIG. 1. Further while only one air inflow slot is depicted in FIGS. 7 and 8 a collar according to the present invention will have enough slots to provide the desired net free flow area as described above.

While reference has been made to various preferred embodiments of the present invention the scope of the invention is only limited by the enclosed claims. Various alterations have been described above and are comprehended by the claims attached. For example, although the louvers as shown have a particular shape to aid in the aerodynamic performance of the device during passive air flow, the present invention comprehends various other louver shapes provided that the air from the fan is directed largely through the vent body while at the same time the louver configuration permits passive air flow therethrough.

I claim:

1. A roof vent comprising:

a main body having an air passageway and being sized and shaped to fit onto an opening in a roof, said roof opening defining an air flow path between an interior and an exterior of a building, said air passageway defining a vent net free flow area;

a collar attached at one end thereof to the main body, said collar being sized and shaped to fit through said roof opening and extend into said interior of said building, said collar including air inflow gaps formed integrally therein;

said collar further including a fan mount at an opposed other end of said collar; and an electrically powered fan mounted to said fan mount, said fan being configured to drive an air flow from said interior of said building, through said collar to said air passageway in said main body, and out said main body to said exterior of said building;

wherein a collar air inflow area, including the air inflow gaps, is within about 5% of the vent net free flow area.

2. The roof vent of claim 1 wherein the air inflow gaps are formed between angled louvers located on said collar.

3. The roof vent of claim 2 wherein said louvers are angled to permit air passively rising towards said roof opening to pass through said air inflow gaps into said collar.

4. The roof vent of claim 2 wherein, in side view, an outer edge of each louver is lower than an inner edge of each louver.

5. The roof vent of claim 2 wherein each successively higher louver, in side view, projects further outwardly from a centerline of said collar that an adjacent louver below.

6. The roof vent of claim 1 further including a source of power for said fan.

7. The roof vent of claim 6 wherein said source of power is one or both of solar power and household power.

8. The roof vent of claim 7 wherein said household power is either stored electrical power or grid electrical power.

9. The roof vent of claim 6 wherein said source of power for said fan is a solar panel mounted above said roof.

10. The roof vent of claim 9 wherein said main body includes a top face and said solar panel is mounted to said top face.

11. The roof vent of claim 1 wherein said fan is centrally mounted below said main body in said fan mount and said collar defines a portion of said air flow passage through said main body.

12. The roof vent of claim 11 wherein said portion of said air passageway defines said air inflow gaps into said collar.

13. The roof vent of claim 12 wherein said air inflow gaps include angled surfaces to help deflect air flow into said collar.

14. The roof vent of claim 13 wherein the cross-sectional area of the collar increases as the distance from the fan increases.

15. The roof vent of claim 14 wherein, in side view said louvers are shaped sized and positioned wherein an upper inner edge of a next adjacent lower louver is inside of an lower outer edge of the next higher louver.

16. The roof vent of claim 12 wherein the collar is tapered and has a larger cross-sectional area towards the roof opening and a smaller cross-sectional area towards the fan mount.

17. The roof vent of claim 1 wherein said collar is a separately molded part.

18. The roof vent of claim 1 wherein said collar is a separately molded part which is attached to said main body of said roof vent.

19. The roof vent of claim 18 wherein said separately molded part is attached to said main body by one or more of heat stakes, plastic welds, glue, and fasteners.

20. The roof vent of claim 1 wherein the collar air inflow area of the collar is within 1% of the vent net free flow area.

21. The roof vent of claim 1 wherein the collar air inflow area is about the same as the vent net free flow area.

22. The roof vent of claim 1, wherein said air inflow gaps are positioned in said collar between said one end of said collar and said fan.

23. The roof vent of claim 1, further comprising an airfoil extension positioned in said collar and extending from said fan towards said roof opening.

24. A roof vent comprising:

a main body having an air passageway and being sized and shaped to fit onto an opening in a roof, said roof opening defining an air flow path between an interior and an exterior of a building, said air passageway defining a vent net free flow area, said main body having a grill defining an open flow area therethrough in a roof portion of the main body;

a collar attached at one end thereof to the main body, said collar being sized and shaped to fit through said roof opening and extend into said interior of said building, said collar including air inflow gaps;

said collar further including a fan mount at an opposed other end of said collar; and an electrically powered fan mounted to said fan mount;

wherein a collar air inflow area, including the air inflow gaps, is within about 5% of the vent net free flow area; and wherein the open flow area of the grill is within about 5% of the vent net free flow area.

* * * * *